United States Patent [19]

Hughes

[11] Patent Number: 4,594,020

[45] Date of Patent: Jun. 10, 1986

[54] WELDED OIL WELL PUMP ROD

[75] Inventor: Rodney F. Hughes, Dallas, Tex.

[73] Assignee: Mega Industrial Products, Inc., Dallas, Tex.

[21] Appl. No.: 607,279

[22] Filed: May 4, 1984

Related U.S. Application Data

[62] Division of Ser. No. 407,807, Aug. 13, 1982, abandoned.

[51] Int. Cl.[4] ..... B25G 3/00; F16B 7/18

[52] U.S. Cl. ..... 403/343; 403/271

[58] Field of Search ..... 403/343, 299, 271, 307

[56] References Cited

U.S. PATENT DOCUMENTS

| | | | |
|---|---|---|---|
| 1,236,145 | 8/1917 | Burns | 403/299 X |
| 2,257,335 | 9/1941 | Evans et al. | 403/271 X |
| 2,690,934 | 10/1954 | Holcombe | 403/307 X |
| 3,489,445 | 1/1970 | Kammerer, Jr. | 403/343 |
| 4,096,787 | 6/1978 | Sandau et al. | 403/271 X |

*Primary Examiner*—Andrew V. Kundrat

*Attorney, Agent, or Firm*—Hubbard, Thurman, Turner & Tucker

[57] ABSTRACT

A wrought aluminum alloy well pump sucker rod is formed using a cylindrical rod section and separately fabricated coupling end portions which are friction welded to the cylindrical rod section at friction welding speeds and forging pressures sufficient to produce an excess amount of radially displaced material or flash in the weld zone. The increased cross-sectional area of the rod formed by the displaced material results in lower unit stress in the transition zone between the cylindrical rod section and the enlarged diameter coupling portions.

3 Claims, 5 Drawing Figures

FIG. 1
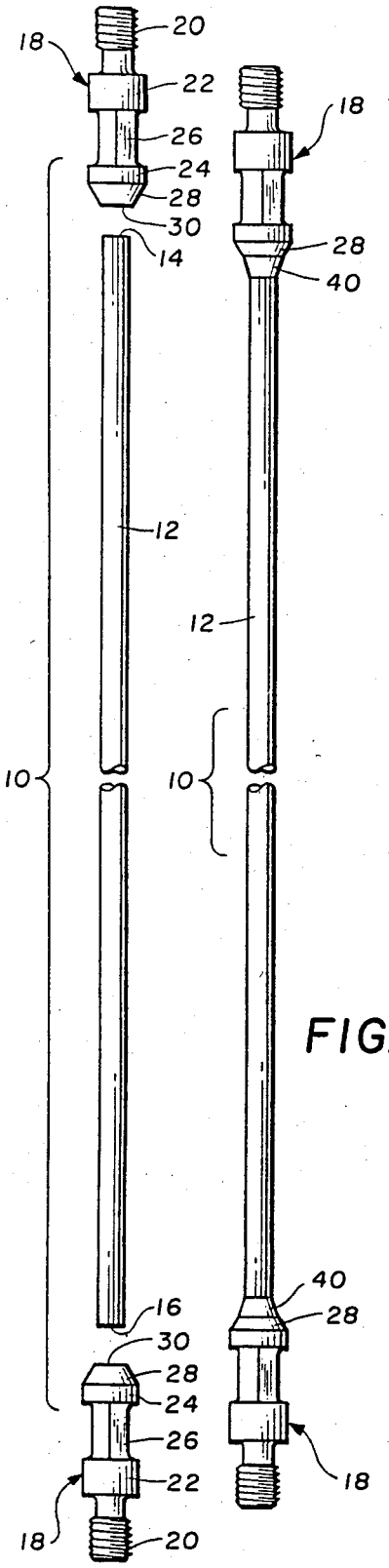
FIG. 2
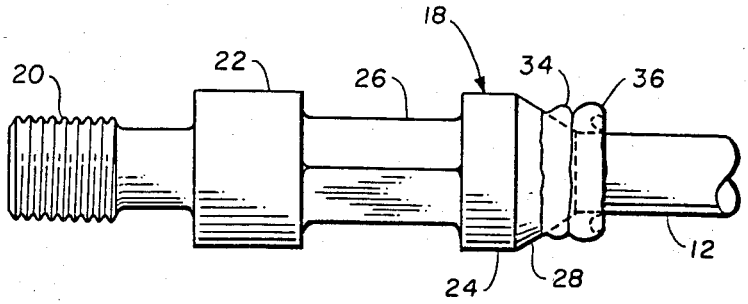
FIG. 3
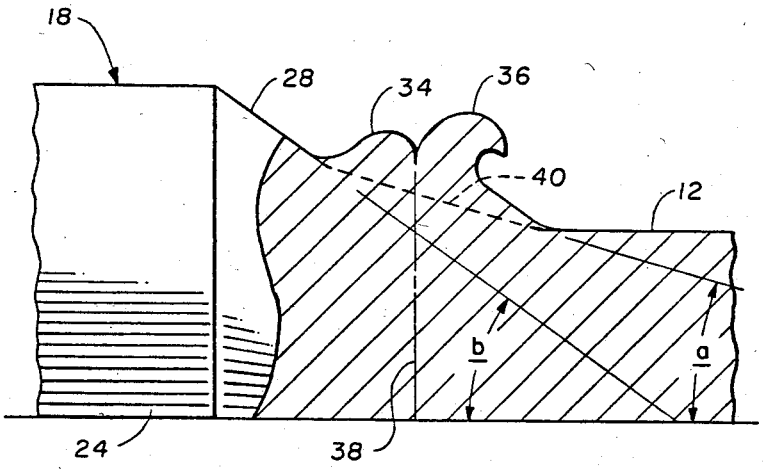
FIG. 4
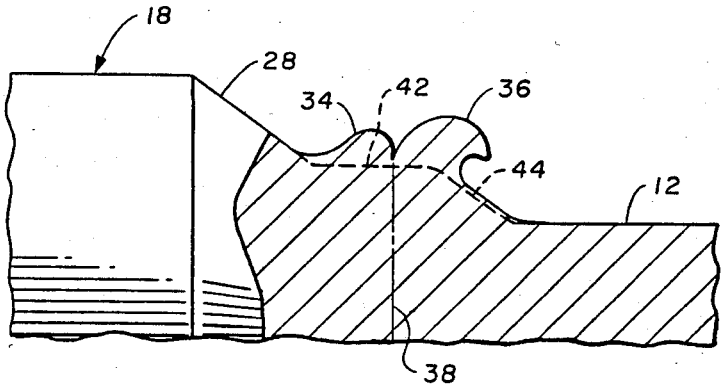
FIG. 5

WELDED OIL WELL PUMP ROD

This application is a division of application Ser. No. 407,807, filed Aug. 13, 1982, now abandoned.

BACKGROUND OF THE INVENTION

1. Field of the Invention

The present invention pertains to elongated oil well pump or sucker rods which are fabricated by friction welding elongated cylindrical rod portions to respective large diameter coupling end portions to provide an improved transition zone between the rod portion and the respective end portions.

2. Background

In the art of elongated well pump rods, commonly referred to as sucker rods, many different materials and rod configurations have been developed in an effort to provide long service life and reasonable manufacturing cost and at the same time providing for efficient operation of the well pumping unit. In regard to the last mentioned requirement the ever increasing depth at which liquid hydrocarbons are being produced has brought the increased realization that the sucker rod string comprises a substantial part of the load imposed on the pumping unit. For example, in a well of average depth in the range of 3500 to 4000 feet the use of steel sucker rods represents approximately 60 to 70% of the work load imposed on the pumping unit. Accordingly, there has been a long felt desire to reduce the weight of the sucker rod string while at the same time retaining adequate strength and corrosion resistance to permit suitable service life of the rods. In this regard various materials have been substituted for steel including aluminum alloys and composite rods using fiberglass and other non-metal materials.

The use of wrought aluminum alloys for oil well sucker rods is particularly attractive in that the significantly lower density of the rod material, as compared with steel, and the relatively high tensile strength of certain aluminum alloys provides for a substantial reduction in the weight of the sucker rod string without increasing the working stress on the rods themselves. Moreover, certain aluminum alloys have indicated superior corrosion resistance in most applications of oil well sucker rod pumping units.

However, one problem associated with the use of aluminum sucker rods is in fabrication of the rods to provide the coupling end portions. Upset forging of wrought aluminum alloy rod stock to form the enlarged portions required for the coupling for connecting one rod section to another has been difficult to accomplish with aluminum alloys while retaining the desired mechanical strength characteristics of aluminum. In this regard other means of forming the coupling ends have been sought. Although, friction welding of elongated tubular members has been attempted the provision of suitably welded sucker rods with the required structural integrity has eluded workers in the art prior to the discovery of the present invention.

SUMMARY OF THE INVENTION

The present invention provides an improved oil well pump rod or sucker rod of a type comprising an elongated cylindrical rod member having enlarged coupling ends adapted for connecting one rod section to another. In accordance with one aspect of the present invention there is provided a metal alloy sucker rod comprising enlarged coupling end portions which are friction welded to a central elongated cylindrical rod section of smaller diameter than the end portions to provide a rod member having tensile strength equivalent to a rod formed from an integral piece of material and further having strength in the area of the weld of the rod section to the coupling end portions equal to or greater than the otherwise weakest section of the rod.

In accordance with another aspect of the present invention there is provided a friction welded wrought aluminum sucker rod wherein the transition between the elongated cylindrical central section of the rod and the coupling end portions which are welded to the central section is of an increased thickness and utilizes material displaced from the central rod section and the coupling end portions during the weld process. By proportioning the transition area or zone between the enlarged diameter coupling end portions of the rod and the smaller diameter central rod section, utilizing displaced material or weld flash, the point at which stress concentrations or raisers are normally encountered has been eliminated and the tensile load at the weld juncture is distributed over a greater area than with prior art welded or integral sucker rods and the like. Accordingly, in the event that there are discontinuities or stress raisers created by an improper weld, which may go undetected, the increased material cross-section area in the vicinity of the weld substantially assurers a lower unit stress.

In accordance with another aspect of the present invention it has been discovered that an improved process of friction welding aluminum sucker rods has been developed wherein, surpisingly, by increasing the rotative speed of the components to be welded and by increasing the axial force applied to the components above the welding process parameters which have been normally accepted for wrought aluminum, that an increased amount of flash has been produced without adverse effects on the weld zone. Moreover, the increased amount of radially outwardly displaced material may be finish machined to remove only a portion thereof whereby the increased section thickness of the rod provided by the flash enhances the strength of the rod itself.

Those skilled in the art will recognize the advantages and superior aspects of the present invention described above as well as other features upon reading the detailed description which follows in conjunction with the drawing.

BRIEF DESCRIPTION OF THE DRAWING

FIG. 1 is a side elevation of the components of an embodiment of an aluminum oil well pump sucker rod of the present invention;

FIG. 2 is a side elevation of the rod illustrated in FIG. 1 upon completion of the welding and finishing process;

FIG. 3 is a side elevation of one of the coupling end portions upon completion of the weld to the central rod section but prior to finish machining of the excess or displaced material;

FIG. 4 is a detail section view of the juncture of the coupling end portion to the central rod section showing the formation of the displaced material or flash and also illustrating the finish form of the transition zone; and, FIG. 5 is a detail view similar to FIG. 4 showing an alternate embodiment of the finish form or profile of the transition zone of the coupling end portion to the central rod section.

DESCRIPTION OF THE PREFERRED EMBODIMENTS

In the description which follows like parts are marked throughout the specification and drawing with the same reference numerals, respectively. The drawing figures are not necessarily to scale and certain detailed features may be exaggerated to better illustrate the invention.

Referring to FIG. 1 there is illustrated the multiple components of an elongated member comprising an oil well pump rod, commonly referred to in the art a sucker rod, generally designated by the numeral 10. The sucker rod 10 includes an elongated cylindrical rod section 12 having opposed transverse end portions 14 and 16. The sucker rod 10 is also adapted to have enlarged coupling end portions which, in the specific embodiment of the rod illustrated, are identical in structure and are each designated by the numeral 18. The coupling end portions may take various specific forms in accordance with the type of coupling to be provided for the end-to-end connected rod sections; however, in the embodiment shown the coupling end portions 18 are provided with external threads 20 on the distal ends thereof and extending from an enlarged cylindrical collar portion 22. A second cylindrical collar portion 24 is formed spaced from the collar portion 22 and the coupling end portions are provided with a square or hexagonal cross-section portion 26 forming wrench flats for engaging a suitable connecting and disconnecting wrench for coupling the sucker rods to each other using an internally threaded coupling member, not shown. The end of the coupling portion 18 opposite the threaded end 20 is provided with a conical taper 28 and a transverse end surface 30 having a diameter approximately equal to the diameter of the cylindrical rod section 12.

Due to the substantial difference in diameter and amount of material required to form the coupling end portions 18 so that they have the desired configuration, it has been determined that in manufacturing a sucker rod, such as the sucker rod 10, of wrought aluminum alloy the integral formation of the coupling end portions by an upset or hot forging process has been generally unsatisfactory and has produced sucker rods with inferior mechanical properties. However, in accordance with the present invention the provision of the cylindrical rod section formed from wrought aluminum mill stock, and the provision of the coupling end portions 18 also formed from wrought mill stock machined or forged to form the wrench surfaces 26 and the threads 20 that these coupling end portions can be suitably joined to the cylindrical rod section by friction welding processes and suitably finished to provide a rod of superior strength and equal to a sucker rod which might be machined in its entirety from a single piece. The latter process of manufacturing a sucker rod having the configuration of the rod 10 is, of course, very uneconomical.

In accordance with the present invention it has been determined that an aluminum alloy pump sucker rod may be fabricated using friction welding techniques and particular wrought aluminum alloys wherein the strength of the finished rod is sufficient to permit replacement of steel rod strings with all aluminum rod strings in many oil well pump applications utilizing aluminum rods with nominal diameters virtually the same as required for steel rods. Moreover, the improved corrosion resistance of all aluminum alloy rods is a further benefit enjoyed through the use of the present invention. In fabricating the all aluminum alloy integral sucker rod 10 illustrated in FIGS. 1 and 2 the coupling end portions 18 are separately formed and are friction welded to the opposed ends of the cylindrical rod section as shown by way of example in FIGS. 3, 4 and 5.

In accordance with an improved process for friction welding wrought aluminum alloy rods it has been determined that the normal friction welding parameters associated with joining cylindrical wrought aluminum alloy parts have been increased approximately two fold. The rotational speeds for particular sizes of parts and the axial butting forces applied to the parts are approximately twice those recommended in the prior art techniques of welding wrought aluminum alloy components. In this regard, for example, the welding of cylindrical rod sections of 0.875 inch diameter to coupling end portions having a maximum diameter of the collar portions 22 and 24 of 1.625 inches may produce suitable welded joints upon rotating the parts relative to each other and in end to end engagement at a speed of approximately 3500 rpm and applying an axial forging pressure of approximately 800 psi for four seconds followed by braking rotation and then applying a forging pressure of 6000 psi. These increased speeds and axial forging pressures produce an excess amount of a radially outwardly directed bulge of component material or flash which effectively increases the cross-sectional area in the transition zone between the coupling end portion and the cylindrical rod section and which results in a lower unit tensile stress in the rod in service. Accordingly, stresses in the transition zone between the cylindrical rod section and the coupling end portions are actually reduced, particularly, with the configuration of the transition zones of the sucker rod of the present invention.

The above friction welding parameters have been suitably applied using wrought aluminum alloys numbers 2014, 6061, and 7129 reference being to the specification numbers of The Aluminum Association, New York, N.Y. The two first mentioned alloys are thermally treated to a T6 temper and the 7129 alloy is treated to a T5 temper before the friction welding process. Although the alloy 2014 has a substantially higher tensile strength that the 6061 alloy its corrosion resistance is generally less than the other alloys.

FIGS. 3, 4 and 5 illustrated details of the formation of the radially outwardly bulged or displaced material on the coupling end portion 18 and the cylindrical rod section 12 during the welding process in accordance with the description herein. Referring to FIG. 3, for example, the coupling end portion 18 is heated sufficiently during the welding process to undergo plastic flow of a portion of the tapered surface 28 to form the radially outwardly extending bulged portion 34. In like manner the cylindrical rod section 12 also is subjected to plastic flow of the end portions 14 or 16 to form a radially outwardly extending bulge 36 representing material displaced from the normal configuration of the rod. The interface designated by the numeral 38 in FIGS. 4 and 5 represents a demarcation between the material displaced from the coupling end portion 18 from that displaced from the cylindrical rod section 12. However, in accordance with typical friction welding processes the metal immediately adjacent the interface between the coupling portion 18 and the rod section 12 undergoes substantial heating to the melting point and forms a zone of commingled material establishing the bond between the separate parts. The substantial heating of the material of each part in the area adjacent the interface 38 results in plastic flow of the material to form the radially outwardly directed bulges 34 and 36. The amount of material displaced from the end of the rod section 12 is slightly greater than the coupling end portion 18 due to the inability of the lower cross-sectional area of the rod section to conduct the friction heat away from the immediate point of contact between the parts.

The flash formed on the respective parts 18 and 12 is greater than that normally encountered in friction welding of wrought aluminum alloys but has been indicated to serve the useful purpose of providing additional material in the transition zone between the cylindrical rod section and the tapered surface 28 of the coupling portion 18 to provide for additional cross-sectional area in the transition zone between the parts so as to reduce the unit tensile stress in the transition zone. In FIG. 4, for example, the dashed line 40 represents the configuration of a tapered surface which may be finish machined to remove the flash radially outward of the surface after the formation of the welded joint. The tapered surface 40 forms an angle a with respect to the central longitudinal axis of the assembled sucker rod 10 which is less than the corresponding angle b of the tapered surface 28. The tapered surface 40 is adapted to utilized the additional material thickness or cross-sectional area of the rod at the transition between the cylindrical rod section and the coupling end portion which is believed to reduce stress concentrations in this area and to compensate for any stress concentrations resulting from possible defects in the weld itself. Test with welds formed on rods using wrought aluminum alloys in accordance with the above described weld parameters have indicated that when placing the welded rod under a tensile load to failure, that parting of the rod occurred in the cylindrical rod section itself remote from the weld zone. The process described herein has been conducted on commercially available friction welding apparatus of a type manufactured by NEI Thompson, Ltd. Ettingshall, Wolverhampton West Midlands, England.

FIG. 5 illustrates an alternate embodiment of the configuration of the transition area or zone between the rod section 12 and the coupling end portion 18 wherein the rod section may be finished to have a generally cylindrical surface portion 42 greater than the diameter of the rod section 12 but less than the diameter of the cylindrical collar portion 24. The transition zone includes a conically tapered surface portion 44 also formed by removing some of the material of the radial extending bulged areas 34 and 36. The configuration illustrated in FIG. 5 utilizes a greater amount of flash material but may increase stress concentrations at the juncture of the surface 44 with the cylindrical rod section 12 as well as the juncture of the cylindrical surface 42 with the conically tapered surface 28. Here again, however, the additional cross-sectional thickness of the integral rod in the transition zone between the cylindrical section 12 and the coupling end portion 18 tends to reduce the unit stress in the weld zone. Moreover, by finish machining the rod end portions to the configuration shown in FIGS. 4 and 5 the appearance of the rod is enhanced and handling characteristics are improved by eliminating the rough surfaces formed by the bulges 34 and 36.

The process of completing the joining of the coupling end portion to the cylindrical rod section also includes shot peening the rod 10 in the transition zones of the welds after machining followed by the application of a corrosion resistant coating to the transition zone. The coating may be a hard anodizing type or a nonmetal coating such as an epoxy.

Those skilled in the art will appreciate from the foregoing that a superior pump sucker rod has been discovered in accordance with the arrangement and process of the present invention. Various substitutions and modifications of the specific features of the invention recited herein may, of course, be readily apparent to those skilled in the art of well pump sucker rods and may be made without departing from the scope and spirit of the invention as recited in the appended claims.

What I claim is:

1. A friction welded multiple component oil well sucker rod comprising an elongated cylindrical rod section and apposed coupling end portions welded to opposite ends of said rod section, said coupling end portions being of a nominal maximum diameter at least 1.5 times greater than said rod section and including means for connecting said sucker rod to an adjacent rod in end to end relationship, said couplings end portions each including an axial tapered portion between said connecting means and an end face adapted to be butted to said rod section, said coupling end portions being butted against said opposed end portions of said rod section during a friction welding operation to form a radially outward projecting bulge of displaced material on said rod section and said coupling end portions, respectively, whereby a greater cross-sectional area is formed at the transition of said rod section to said coupling end portion to reduce the unit tensile stress on said sucker rod in the vicinity of the weld, wherein said displaced material is machined to form a tapered surface between said rod section and said axial tapered portion of said coupling end portion, said tapered surface having an angle of taper with respect to the longitudinal axis of said sucker rod less than the angle of taper of said coupling end portion.

2. The sucker rod set forth in claim 1 wherein:

said rod section and said coupling end portions are formed of wrought aluminum alloy.

3. A multiple component aluminum alloy oil well sucker rod comprising:

an elongated cylindrical solid rod section having opposed transverse end faces;

opposed coupling end portions each being of a nominal maximum diameter at least 1.5 times greater than said rod section and including means for connecting said sucker rod to an adjacent rod in an end to end relationship, said coupling end portions each including an axially spaced tapered portion between said connecting means and a transverse end face adapted to be butted to said rod section at respective ones of said transverse end faces of said rod section; and said coupling end portions being friction welded to said rod section at said transverse end faces, respectively, to form radially outwardly directed bulges of said coupling end portions and said rod section at said transverse end faces and with respect to the longitudinal axis of said sucker rod to form a transition zone between said coupling end portions and said rod section, respectively, said transition zone being machined to form a conically tapered surface delimiting said transition zone and forming a portion of said sucker rod of greater cross-sectional area than said rod section, each of said tapered surfaces forming an angle with respect to said axis less than an angle formed by said tapered portions of said coupling end portions, respectively, whereby each of said transition zones reduces unit tensile stress concentration on said sucker rod during use thereof in a rod string.

* * * * *